US011033942B2

(12) United States Patent
Tachibana

(10) Patent No.: US 11,033,942 B2
(45) Date of Patent: Jun. 15, 2021

(54) ROLLING MILL EXIT SIDE TEMPERATURE CONTROL SYSTEM

(71) Applicant: TOSHIBA MITSUBISHI-ELECTRIC INDUSTRIAL SYSTEMS CORPORATION, Chuo-ku (JP)

(72) Inventor: Minoru Tachibana, Chuo-ku (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 250 days.

(21) Appl. No.: 16/307,539

(22) PCT Filed: Aug. 9, 2016

(86) PCT No.: PCT/JP2016/073379

§ 371 (c)(1),
(2) Date: Dec. 6, 2018

(87) PCT Pub. No.: WO2018/029768

PCT Pub. Date: Feb. 15, 2018

(65) Prior Publication Data

US 2019/0151918 A1 May 23, 2019

(51) Int. Cl.
*B21B 37/74* (2006.01)
*B21B 37/32* (2006.01)
(Continued)

(52) U.S. Cl.
CPC ..... *B21B 37/32* (2013.01); *B21B 37/74* (2013.01); *B21B 45/0233* (2013.01); *B21B 38/006* (2013.01); *B21B 45/0218* (2013.01)

(58) Field of Classification Search
CPC . B21B 1/22; B21B 2001/225; B21B 2001/37; B21B 2001/44; B21B 37/74;
(Continued)

(56) References Cited

U.S. PATENT DOCUMENTS 3,589,160 A * 6/1971 Gruver ..... B21B 37/76 72/201
3,779,054 A * 12/1973 Greenberger ..... B21B 37/74 72/12.2
(Continued)

FOREIGN PATENT DOCUMENTS

CN 101394945 A 3/2009
CN 105499285 A 4/2016
(Continued)

OTHER PUBLICATIONS

Office Action dated Apr. 17, 2020 in Chinese Patent Application No. 201680086875.5, 11 pages.
(Continued)

*Primary Examiner* — Edward T Tolan
(74) *Attorney, Agent, or Firm* — Xsensus LLP

(57) ABSTRACT

A rolling mill exit side temperature control system includes the following features. A second valve control unit controls a valve opening of a second valve to cause a flow rate actual value detected by a flow rate detector to coincide with a flow rate target value. A remaining coolant discharging section controls a first valve to an open state and the second valve to a closed state by setting the flow rate target value to zero, before a material to be rolled reaches a rolling mill. A flow rate target value setting section sets the flow rate target value to a value corresponding to a target temperature of the material to be rolled on the entry side and the exit side of the rolling mill after the control by the remaining coolant discharging section.

5 Claims, 7 Drawing Sheets

(51) Int. Cl.
*B21B 45/02* (2006.01)
*B21B 38/00* (2006.01)

(58) Field of Classification Search
CPC ... B21B 37/76; B21B 38/006; B21B 45/0218; B21B 45/0233; B21B 2261/20; B21B 45/02; B21B 45/0203; B21B 45/0215
See application file for complete search history.

(56) References Cited

U.S. PATENT DOCUMENTS 4,379,396 A * 4/1983 Hope ..... B21B 37/44 72/8.5
4,932,232 A * 6/1990 Ballyns ..... B05B 12/04 72/201
5,235,840 A * 8/1993 Blazevic ..... B21B 37/74 72/201
7,926,316 B2 4/2011 Tachibana

FOREIGN PATENT DOCUMENTS

JP 54-132454 A * 10/1979 ..... B21B 37/76
JP 59-76616 A * 5/1984 ..... B21B 45/08
JP 60-18218 A * 1/1985 ..... B21B 45/02
JP 60-124411 A 7/1985
JP 61-15926 A * 1/1986 ..... B21B 45/02
JP 08-243620 A 9/1996
JP 10-192951 A * 7/1998 ..... B21B 45/02
JP 10-277627 A 10/1998

OTHER PUBLICATIONS

Brazilian Office Action dated Jul. 30, 2020, issued in corresponding Brazilian Patent Application 112018074428-0.
International Search Report dated Nov. 15, 2016 in PCT/JP2016/073379 filed Aug. 9, 2016.
Chinese Office Action dated Feb. 3, 2020, issued in corresponding Chinese Patent Application No. 201680086875.
Office Action dated Jun. 29, 2020 in Indian Patent Application No. 201817049751, 6 pages.
Combined Office Action and Search Report dated Aug. 13, 2019 in Chinese Patent Application No. 201680086875.5 (with unedited computer generated English translation of the Office Action and English translation of categories of cited documents), citing documents AO and AP therein, 15 pages.
Office Action dated Sep. 2, 2020, in corresponding Chinese Application No. 201680086875.5, 8 pages.

* cited by examiner

ROLLING MILL EXIT SIDE TEMPERATURE CONTROL SYSTEM

FIELD

The present disclosure relates to a rolling mill exit side (delivery side) temperature control system. In particular, the present disclosure relates to a hot rolling mill exit side temperature control system.

BACKGROUND

In a hot rolling line, controlling the temperature of a material to be rolled to maintain a target temperature on the exit side of a hot rolling mill is an important matter to ensure excellent quality of the material to be rolled.

A hot rolling mill exit side temperature control system disclosed in, for example, JP H10-277627 A (PTL 1) is well-known. The hot rolling mill includes a plurality of rolling stands rolling the material to be rolled, and a cooling spray system to spray cooling water onto the material to be rolled in the spaces between the rolling stands. Typically, the cooling spray system includes a spray nozzle at a downstream end of a cooling water passage, an openable spray valve upstream of the spray nozzle, and a butterfly valve upstream of the spray valve that can adjust a flow rate per unit time.

CITATION LIST

Patent Literature

[PTL 1] JP H10-277627 A

SUMMARY

Technical Problem

FIG. 7 is a timing chart to explain the conventional temperature control by the above-described cooling spray system. Time t1 is the timing when the material to be rolled reaches the rolling mill. Time t2 is the timing of the cooling instruction for discharging cooling water. At the time t2, the butterfly valve is open (line 82), and the spray valve is switched from a closed state (OFF) to an open state (ON) (line 81). In other words, the spray valve on the nozzle side is opened at the same timing as the cooling instruction. At this time, in addition to an instructed amount of cooling water, cooling water remaining in the cooling water passage between the butterfly valve and the spray valve is also discharged. Accordingly, a larger amount than the instructed amount of cooling water gets on the material to be rolled, and the material to be rolled is rapidly cooled. As a result, the accuracy of the temperature control deteriorates, which increases temperature variation of the material to be rolled and influences the accuracy of thickness control.

The present disclosure is made to solve the above-described issues, and an object of the present disclosure is to provide a rolling mill exit side temperature control system that makes it possible to suppress rapid cooling of the material to be rolled to improve accuracy of the temperature control, and to improve accuracy of thickness control.

Solution to Problem

To achieve the above-described purpose, according to the present disclosure, a rolling mill exit side temperature control system including a plurality of rolling stands rolling a material to be rolled, includes a cooling apparatus provided in at least one of a plurality of spaces between the rolling stands, and a cooling apparatus control unit controlling the cooling apparatus. The cooling apparatus includes a spray nozzle spraying coolant onto the material to be rolled, a coolant passage supplying the coolant to the spray nozzle, a first valve provided in the coolant passage upstream of the spray nozzle and being changeable to an open state or a closed state, a first valve control unit controlling the first valve to the open state or the closed state, a second valve provided in the coolant passage upstream of the first valve and being changeable in valve opening, a flow rate detector detecting a flow rate of the coolant flowing through the coolant passage upstream of the second valve, and a second valve control unit controlling the valve opening of the second valve to cause a flow rate actual value detected by the flow rate detector to coincide with a flow rate target value. The cooling apparatus control unit includes a remaining coolant discharging section controlling the first valve to the open state and the second valve to the closed state by setting the flow rate target value to zero before the material to be rolled reaches the rolling mill, and a flow rate target value setting section setting the flow rate target value to a value corresponding to a target temperature of the material to be rolled on the entry side and the exit side of the rolling mill after the control by the remaining coolant discharging section.

Advantageous Effects of Invention

According to the present disclosure, before the material to be rolled next reaches the rolling mill, the first valve is controlled to the open state and the second valve is controlled to the closed state, which makes it possible to discharge the coolant remaining in the coolant passage downstream of the second valve, at a timing when the coolant will not get on the material to be rolled. Thereafter, the flow rate target value corresponding to the target temperature of the material to be rolled is set, and the instructed amount of the coolant is sprayed onto the material to be rolled. As a result, according to the present disclosure, it is possible to suppress rapid cooling of the material to be rolled to improve accuracy of temperature control, and to improve accuracy of thickness control.

DESCRIPTION OF EMBODIMENTS

Figure 1:
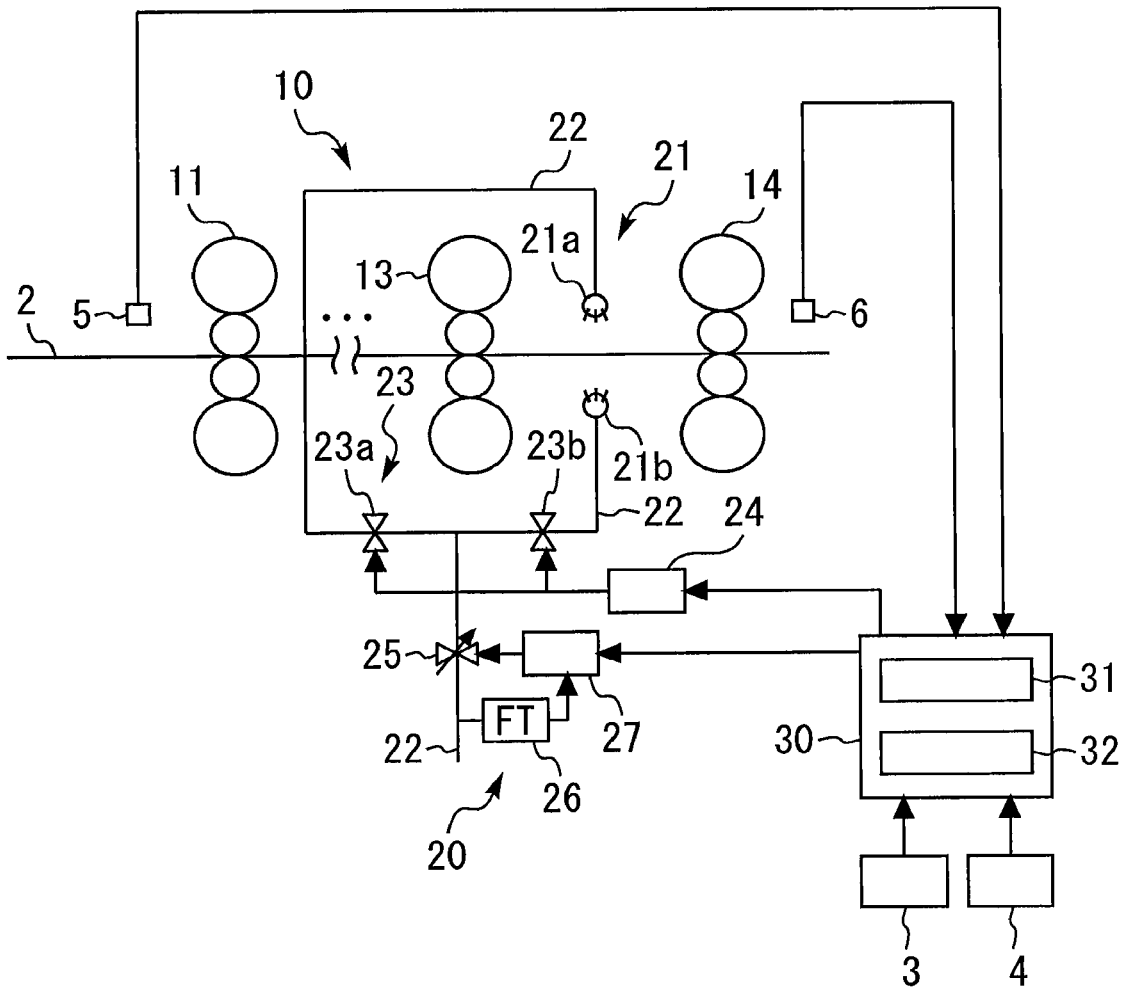
FIG. 1 is a conceptual diagram to explain a configuration of an exit side temperature control system according to a first embodiment of the present disclosure.

Embodiments of the present disclosure are described in detail below with reference to the drawings. Note that components common to the drawings are denoted by the same reference numerals and overlapped description of the components is omitted.

First Embodiment

<Entire Configuration>

FIG. 1 is a conceptual diagram to explain a configuration of an exit side temperature control system according to a first embodiment of the present disclosure. FIG. 1 illustrates a part of a hot rolling line. The hot rolling line includes a rolling mill 10. The rolling mill 10 is, for example, a hot rolling mill. The hot rolling mill is, for example, a roughing mill or a finishing mill. In the following description, it is assumed that the rolling mill 10 is a finishing mill as an example.

The rolling mill 10 includes a plurality of rolling stands rolling a material to be rolled 2. Some of n rolling stands arranged in tandem are illustrated in FIG. 1 (n>1, n is natural number). More specifically, a first rolling stand 11 disposed at the most upstream, an n−1-th rolling stand 13, and an n-th rolling stand 14 disposed at the most downstream are illustrated.

<Cooling Apparatus>

A cooling apparatus is provided in at least one of a plurality of spaces between the rolling stands. The cooling apparatus is a cooling spray system to spray coolant toward the material to be rolled 2. In FIG. 1, a cooling apparatus 20 provided in a space between the n−1-th rolling stand 13 and the n-th rolling stand 14 is illustrated.

The cooling apparatus 20 includes spray nozzles 21 (upper spray nozzle 21*a* and lower spray nozzle 21*b*), a coolant passage 22, first valves 23 (upper spray valve 23*a* and lower spray valve 23*b*), a first valve control unit 24, a second valve 25, a flow rate detector 26, and a second valve control unit 27.

The upper spray nozzle 21*a* is a spray nozzle to spray the coolant onto an upper surface of the material to be rolled 2. The lower spray nozzle 21*b* is a spray nozzle to spray the coolant onto a lower surface of the material to be rolled 2. In the following description, in a case where it is unnecessary to distinguish the upper spray nozzle 21*a* and the lower spray nozzle 21*b* from each other, the spray nozzles are simply referred to as the spray nozzles 21. The spray nozzles 21 are connected to respective downstream ends of the coolant passage 22. The spray nozzles 21 are disposed between the n−1-th rolling stand 13 and the n-th rolling stand 14.

The coolant passage 22 is a pipe to supply the coolant to the spray nozzles 21. Examples of the coolant include cooling water, cooling oil, and other solutions.

The upper spray valve 23*a* is provided on the coolant passage 22 upstream of the upper spray nozzle 21*a*, and is changeable to an open state or a closed state. The lower spray valve 23*b* is provided on the coolant passage 22 upstream of the lower spray nozzle 21*b*, and is changeable to an open state or a closed state. In the following description, in a case where it is unnecessary to distinguish the upper spray valve 23*a* and the lower spray valve 23*b* from each other, the valves are simply referred to as the first valves 23.

The first valve control unit 24 controls the open/closed states of the first valves 23. More specifically, the first valve control unit 24 controls the first valves 23 to the open state in response to an ON signal from the cooling apparatus control unit 30, and controls the first valves 23 to the closed state in response to an OFF signal from the cooling apparatus control unit 30.

The second valve 25 is a butterfly valve that is provided on the coolant passage 22 upstream of the first valves 23 and a valve opening thereof is changeable. Amount and pressure of the coolant are adjusted according to the valve opening.

The flow rate detector 26 is a flow transducer that detects a flow rate per unit time of the coolant flowing through the coolant passage 22 upstream of the second valve 25.

The second valve control unit 27 controls the valve opening of the second valve 25 such that a flow rate actual value detected by the flow rate detector 26 coincides with a flow rate target value (closed loop control). The flow rate target value is provided through the cooling apparatus control unit 30. The second valve control unit 27 changes the valve opening of the second valve 25 based on a difference between the flow rate actual value and the flow rate target value. For example, in a case where the flow rate target value is set to zero, the valve opening is controlled so as to be fully closed (opening 0%).

<Cooling Apparatus Control Unit>

The system illustrated in FIG. 1 includes the cooling apparatus control unit 30 that controls the cooling apparatus 20. The cooling apparatus control unit 30 is used to cool the temperature of the material to be rolled 2 on the exit side of the rolling mill 10 to a target temperature. A tracking apparatus 3, a host computer 4, a rolling mill entry side temperature sensor 5, a rolling mill exit side temperature sensor 6 are connected to the input side of the cooling apparatus control unit 30. The first valve control unit 24 and the second valve control unit 27 are connected to the output side of the cooling apparatus control unit 30. The cooling apparatus control unit 30 sequentially receives signals from the tracking apparatus 3, the host computer 4, the rolling mill entry side temperature sensor 5, and the rolling mill exit side temperature sensor 6.

The tracking apparatus 3 outputs tracking information including a head end position and speed of the material to be rolled 2.

The host computer 4 outputs an entry side temperature target value that is the target temperature of the material to be rolled 2 on the entry side of the rolling mill 10, an exit side temperature target value that is the target temperature of the material to be rolled 2 on the exit side of the rolling mill 10, a speed pattern, a specification of the material to be rolled 2, and the like.

The rolling mill entry side temperature sensor 5 is provided on the entry side of the rolling mill 10 (upstream of the first rolling stand 11), and outputs the surface temperature of the passing material to be rolled 2. In the case of the finishing mill, the finisher entry temperature (FET) is detected.

The rolling mill exit side temperature sensor 6 is provided on the exit side of the rolling mill 10 (downstream of n-th rolling stand 14), and outputs the surface temperature of the passing material to be rolled 2. In the case of the finishing mill, the finisher delivery temperature (FDT) is detected.

The cooling apparatus control unit 30 includes a remaining coolant discharging section 31 and a flow rate target value setting section 32.

The remaining coolant discharging section 31 controls the first valves 23 to the open state, and controls the second valve 25 to the closed state by setting the flow rate target value to zero, before the material to be rolled 2 reaches the rolling mill 10. More specifically, when the remaining coolant discharging section 31 provides the ON signal to the first valve control unit 24, the first valves 23 are controlled to the open state. Further, the remaining coolant discharging section 31 sets the flow rate target value to be provided to the second valve control unit 27, to zero. As a result, the valve opening of the second valve 25 is controlled to the fully-closed state so as to bring the flow rate actual value close to zero, by the closed loop control.

The flow rate target value setting section 32 sets the flow rate target value to a value corresponding to the target temperature of the material to be rolled 2 on the entry side and the exit side of the rolling mill 10, after the control by the remaining coolant discharging section 31. When the flow rate target value is changed from zero to a predetermined flow rate target value (>0), the valve opening of the second valve 25 is increased from zero to the opening corresponding to the predetermined flow rate target value, by the closed loop control.

The flow rate target value setting section 32 executes feedforward control. In a case where the entry side temperature target value, the exit side temperature target value, and a flow rate reference value of the coolant corresponding to the speed pattern are determined and the entry side temperature actual value detected by the rolling mill entry side temperature sensor 5 is higher than the entry side temperature target value, the flow rate target value setting section 32 sets the flow rate target value to a value larger than the flow rate reference value according to a difference therebetween. In contrast, in a case where the entry side temperature actual value is lower than the entry side temperature target value, the flow rate target value setting section 32 sets the flow rate target value to a value lower than the flow rate reference value according to the difference, by the feedforward control.

Further, the flow rate target value setting section 32 starts execution of feedback control at a time when the material to be rolled 2 reaches the rolling mill exit side temperature sensor 6. The flow rate target value setting section 32 corrects the flow rate target value based on a difference between the exit side temperature actual value and the exit side temperature target value such that the exit side temperature actual value detected by the rolling mill exit side temperature sensor 6 coincides with the exit side temperature target value (PI control).

<Timing Chart>

Figure 2:
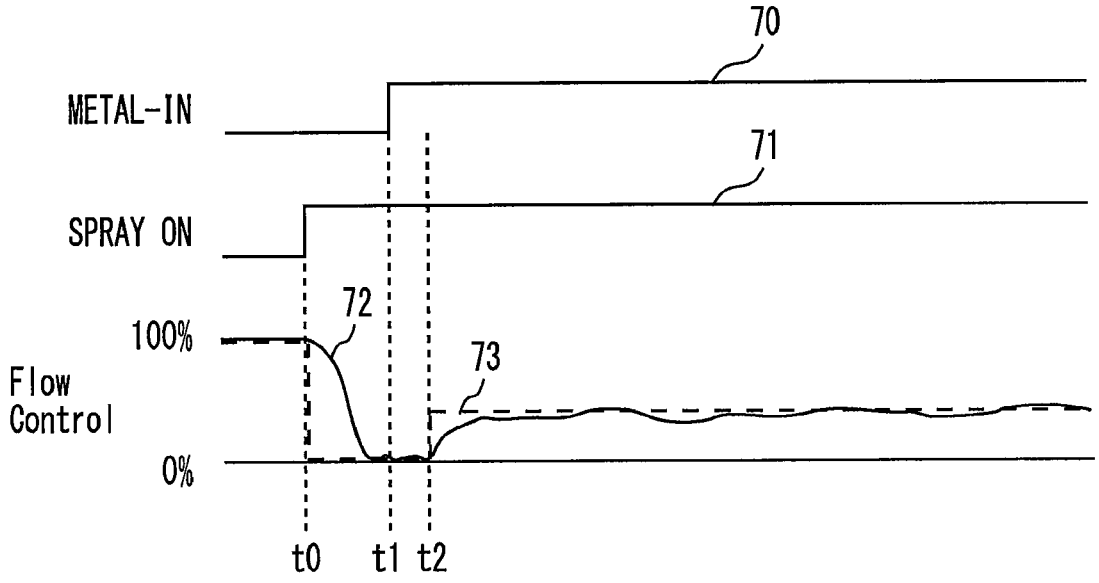
FIG. 2 is a timing chart to explain the temperature control of the system.

FIG. 2 is a timing chart to explain temperature control of the system according to the first embodiment of the present disclosure. Time t0 is the timing before the material to be rolled 2 reaches the rolling mill 10. Time t1 is the timing when the material to be rolled 2 reaches the rolling mill 10. Time t2 is the timing of the cooling instruction.

At the time t0, the first valves 23 are controlled to the open state (line 71). In addition, at the time t0, the flow rate target value is set to zero (line 73). When the flow rate target value is set to zero, the valve opening of the second valve 25 is controlled to the fully-closed state so as to bring the flow rate actual value close to zero, by the closed loop control (line 72). In other words, before the material to be rolled 2 reaches the rolling mill 10, the first valves 23 are controlled to the open state and the second valve 25 is controlled to the fully-closed state, and the coolant remaining in the coolant passage 22 downstream of the second valve 25 is discharged from the spray nozzles 21. Since the coolant is discharged before the time t1, the coolant does not get on the material to be rolled 2.

At the time t1, the material to be rolled 2 reaches the entry side of the rolling mill 10 (line 70). At the time t2, a new flow rate target value (>0) is set by the flow rate target value setting section 32 (line 73). Thereafter, the valve opening of the second valve 25 is controlled to a predetermined opening by the closed loop control based on the set flow rate target value, and the coolant amount corresponding to the flow rate target value is sprayed.

<Flowchart>

Figure 3:
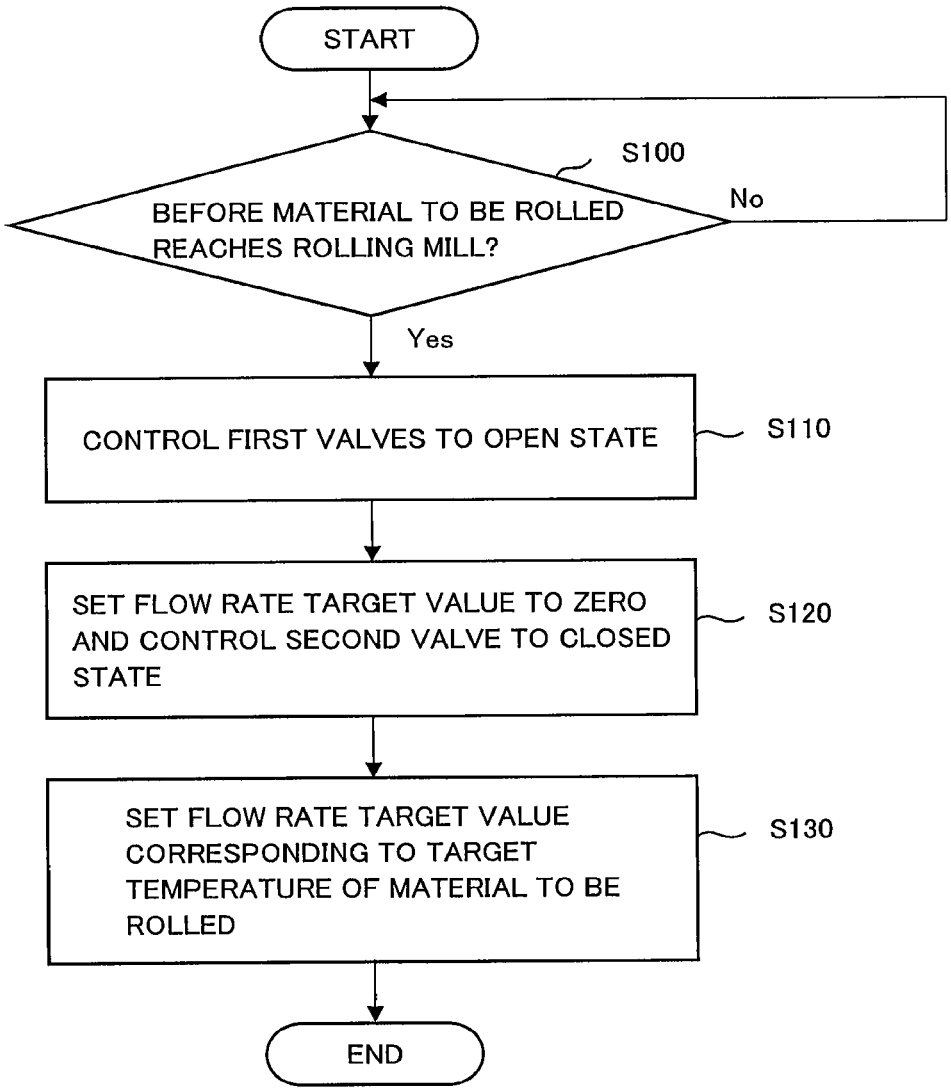
FIG. 3 is a flowchart of a control routine executed by a cooling apparatus control unit 30 according to the first embodiment of the present disclosure.

FIG. 3 is a flowchart of a control routine executed by the cooling apparatus control unit 30 to realize the above-described operation.

First, in step S100, the cooling apparatus control unit 30 determines whether the head end position of the material to be rolled 2 has reached the entry side of the rolling mill 10, based on the tracking information. In a case where it is determined to be before reaching, the processing of step S110 is executed next. In a case where it is determined to be after reaching, passage of the material to be rolled 2 is waited for.

In step S110, the first valves 23 are controlled to the open state. More specifically, the remaining coolant discharging section 31 provides ON signal to the first valve control unit 24. The first valve control unit 24 receives the ON signal to control the first valves 23 to the open state. Note that, as a condition, spraying of the coolant onto the preceding material to be rolled 2 is already completed. In other words, a tail end of the preceding material to be rolled 2 has already passed through the rolling mill 10 (spray range by cooling apparatus 20).

Next, in step S120, the second valve 25 is controlled to the closed state by setting the flow rate target value to zero. More specifically, the remaining coolant discharging section 31 sets the flow rate target value of the second valve control unit 27 to zero. The second valve control unit 27 controls, by the closed loop control, the valve opening of the second valve 25 to the fully-closed state such that the flow rate actual value becomes zero. As a result of the processing in step S110 and step S120, the coolant remaining in the coolant passage 22 downstream of the second valve 25 is discharged from the spray nozzles 21.

Next, in step S130, the flow rate target value (>0) corresponding to the target temperature of the material to be rolled 2 is set. More specifically, the flow rate target value setting section 32 sets the flow rate target value to a value corresponding to the target temperature of the material to be rolled 2 on the entry side and the exit side of the rolling mill 10, after execution of the processing in step S120. As a result, the valve opening of the second valve 25 is controlled to the predetermined opening by the closed loop control based on the set flow rate target value, and the coolant amount corresponding to the flow rate target value is sprayed.

<Effects>

As described above, according to the routine illustrated in FIG. 3, before the material to be rolled 2 next reaches the rolling mill 10, the first valves 23 are controlled to the open state and the second valve 25 is controlled to the closed state, and the coolant remaining in the coolant passage 22 downstream of the second valve 25 can be discharged at the timing when the coolant does not get on the material to be rolled 2. Thereafter, the flow rate target value corresponding to the target temperature of the material to be rolled 2 is set, and the instructed amount of the coolant is sprayed onto the material to be rolled 2. Therefore, according to the system of the present embodiment, it is possible to reduce disturbance, to suppress rapid cooling of the material to be rolled 2, and to control the rolling mill exit side temperature to the target temperature. Further, since the rapid cooling of the material to be rolled 2 is suppressed, it is possible to improve accuracy of thickness control. Moreover, since the rapid cooling of the material to be rolled 2 is suppressed, it is possible to stabilize passability.

<Modifications>

Incidentally, in the system according to the first embodiment, the cooling apparatus 20 may be disposed in any of the spaces between the rolling stands. Further, the rolling mill 10 may be a roughing mill. Moreover, although two sets of the spray nozzles and the spray valves are illustrated in FIG. 1, the number of sets of the spray nozzles and the spray valves may be one or three or more. Note that these modifications are also applicable to the second embodiment.

Second Embodiment

<Entire Configuration>

Next, a second embodiment of the present disclosure is described with reference to FIG. 4 and FIG. 5. A system according to the present embodiment is realized by causing a cooling apparatus control unit 60 to execute a routine of FIG. 5 described later in a configuration illustrated in FIG. 4.

In the above-described first embodiment, the cooling apparatus control unit 30 that controls one cooling apparatus 20 has been described. The cooling apparatus, however, is typically disposed in a plurality of spaces between the rolling stands. Accordingly, in the second embodiment, the cooling apparatus control unit 60 that controls a plurality of cooling apparatuses is described.

Figure 4:
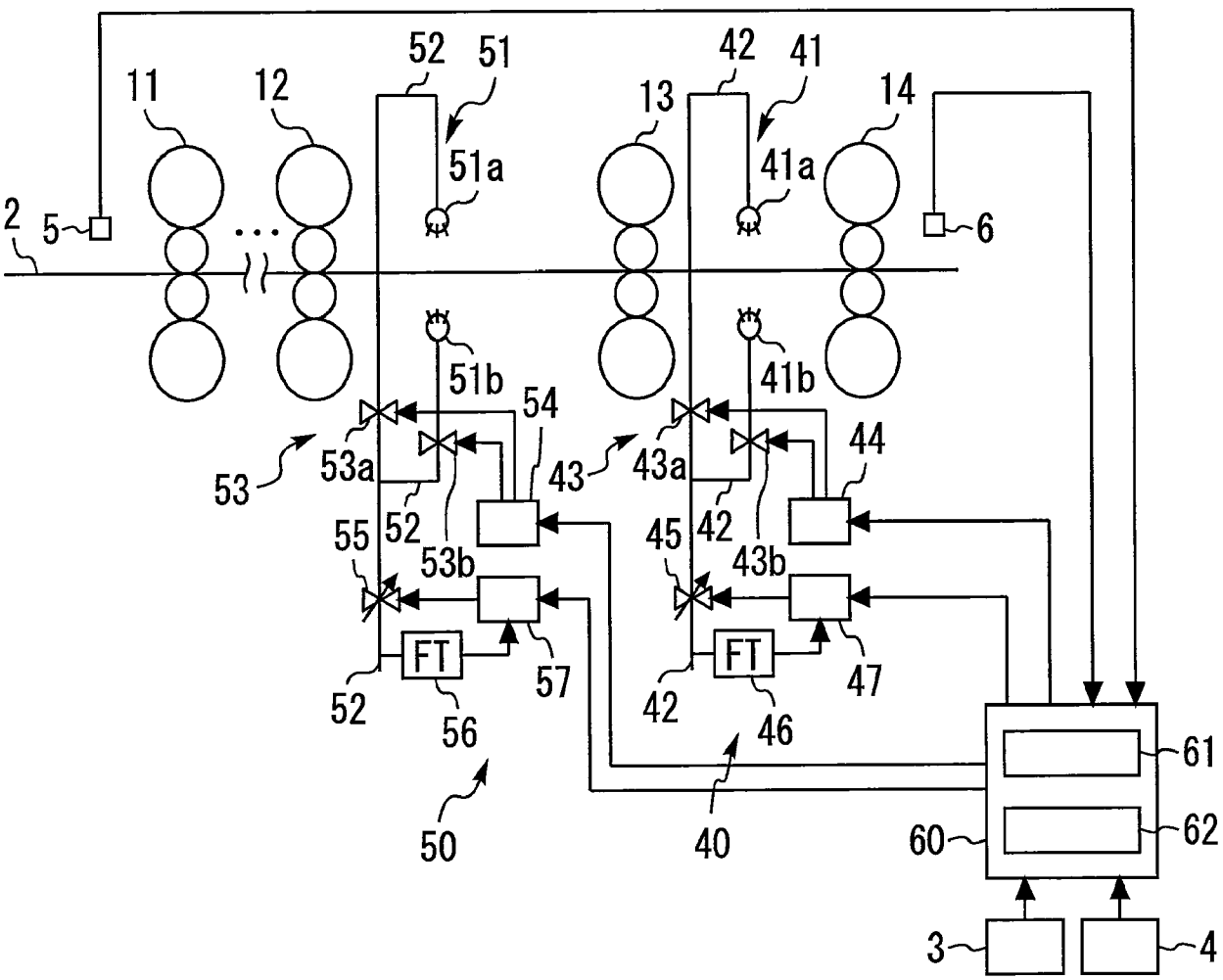
FIG. 4 is a conceptual diagram to explain a configuration of an exit side temperature control system according to a second embodiment of the present disclosure.

FIG. 4 is a conceptual diagram to explain a configuration of an exit side temperature control system according to the second embodiment of the present disclosure. The system illustrated in FIG. 4 includes a downstream cooling apparatus 40, an upstream cooling apparatus 50, and the cooling apparatus control unit 60, in place of the cooling apparatus 20 and the cooling apparatus control unit 30 illustrated in FIG. 1. Description of configurations equivalent to the configurations in FIG. 1 is simplified or omitted.

<Plurality of Cooling Apparatuses>

The downstream cooling apparatus 40 is provided in at least one of the plurality of spaces between the rolling stands. In the example illustrated in FIG. 4, the downstream cooling apparatus 40 is provided in the space between the n−1-th rolling stand 13 and the n-th rolling stand 14.

The downstream cooling apparatus 40 includes spray nozzles 41 (upper spray nozzle 41*a* and lower spray nozzle 41*b*), a coolant passage 42, first valves 43 (upper spray valve 43*a* and lower spray valve 43*b*), a first valve control unit 44, a second valve 45, a flow rate detector 46, and a second valve control unit 47. Configurations of these components are similar to the configurations of the respective components included in the cooling apparatus 20 described in the first embodiment.

The upstream cooling apparatus 50 is provided in any of the plurality of spaces between the rolling stands upstream of the downstream cooling apparatus 40. In the example illustrated in FIG. 4, the upstream cooling apparatus 50 is provided in a space between the n−2-th rolling stand 12 and the n−1-th rolling stand 13.

The upstream cooling apparatus 50 includes spray nozzles 51 (upper spray nozzle 51*a* and lower spray nozzle 51*b*), a coolant passage 52, first valves 53 (upper spray valve 53*a* and lower spray valve 53*b*), a first valve control unit 54, a second valve 55, a flow rate detector 56, and a second valve control unit 57. The spray nozzles 51 are provided in the space between the n−2-th rolling stand 12 and the n−1-th rolling stand 13. Configurations of other components are similar to the configurations of the components included in the cooling apparatus 20 described in the first embodiment.

<Cooling Apparatus Control Unit>

The system illustrated in FIG. 4 includes the cooling apparatus control unit 60 that controls the downstream cooling apparatus 40 and the upstream cooling apparatus 50. The tracking apparatus 3, the host computer 4, the rolling mill entry side temperature sensor 5, and the rolling mill exit side temperature sensor 6 are connected to the input side of the cooling apparatus control unit 60. The first valve control unit 44 and the second valve control unit 47 of the downstream cooling apparatus 40 and the first valve control unit 54 and the second valve control unit 57 of the upstream cooling apparatus 50 are connected to the output side of the cooling apparatus control unit 60. The cooling apparatus control unit 60 sequentially receives signals from the tracking apparatus 3, the host computer 4, the rolling mill entry side temperature sensor 5, and the rolling mill exit side temperature sensor 6.

The cooling apparatus control unit 60 includes a remaining coolant discharging section 61 and a flow rate target value setting section 62.

The remaining coolant discharging section 61 controls the first valves 43 and 53 to the open state, and controls the second valves 45 and 55 to the closed state by setting the flow rate target value to zero, in the downstream cooling apparatus 40 and the upstream cooling apparatus 50, before the material to be rolled 2 reaches the rolling mill 10. More specifically, when the remaining coolant discharging section 61 provides ON signal to the first valve control units 44 and 54, the first valves 43 and 53 are controlled to the open state. Further, the remaining coolant discharging section 61 sets the flow rate target value to be provided to the second valve control units 47 and 57, to zero. As a result, the valve opening of each of the second valves 45 and 55 is controlled to the fully-closed state so as to bring the flow rate actual value close to zero, by the closed loop control.

The flow rate target value setting section 62 sets the flow rate target value of the downstream cooling apparatus 40 to a value corresponding to the target temperature of the material to be rolled 2 on the exit side of the rolling mill 10, after the control by the remaining coolant discharging section 61. When the flow rate target value is changed from zero to a predetermined flow rate target value (>0), the valve opening of the second valve 45 is increased from zero to the opening corresponding to the predetermined flow rate target value, by the closed loop control.

In a case where cooling capacity of the downstream cooling apparatus 40 is not saturated, the flow rate target value setting section 62 sets the flow rate target value of the upstream cooling apparatus 50 to zero.

In contrast, in a case where the cooling capacity of the downstream cooling apparatus 40 is saturated, the flow rate target value setting section 62 sets the flow rate target value of the upstream cooling apparatus 50 to a value corresponding to the target temperature of the material to be rolled on the entry side and the exit side of the rolling mill 10. More specifically, as the flow rate target value of the upstream cooling apparatus 50, an amount of coolant that is insufficient with the cooling capacity (maximum coolant amount) of the downstream cooling apparatus 40 is set. When the flow rate target value is changed from zero to the predetermined flow rate target value (>0), the valve opening of the second valve 55 is increased from zero to the opening corresponding to the predetermined flow rate target value, by the closed loop control.

Note that, as with the flow rate target value setting section 32 described in the first embodiment, the flow rate target value setting section 62 executes feedforward control and feedback control.

<Flowchart>

Figure 5:
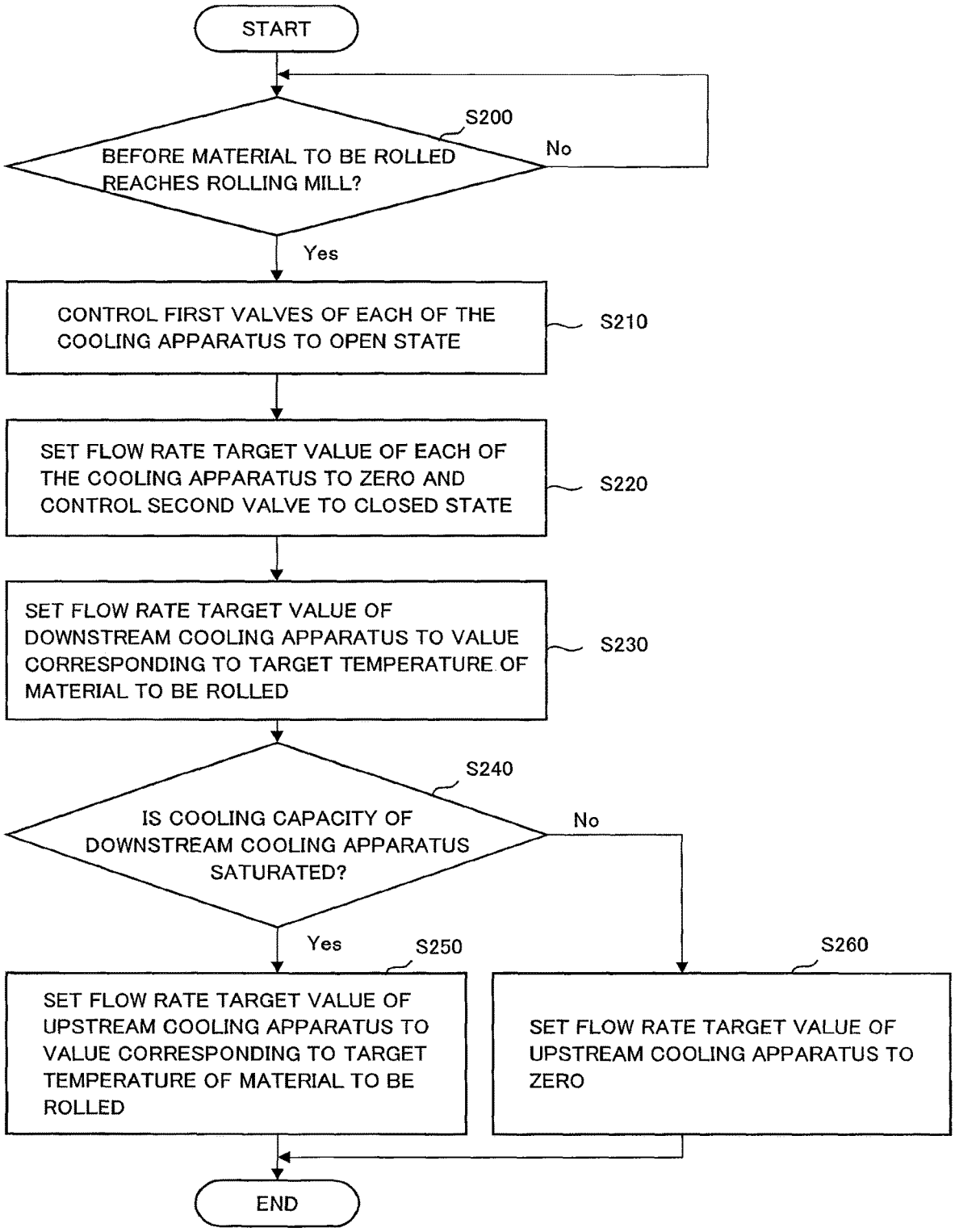
FIG. 5 is a flowchart of a control routine executed by a cooling apparatus control unit 60 according to the second embodiment of the present disclosure.

FIG. 5 is a flowchart of a control routine executed by the cooling apparatus control unit 60 to realize the above-described operation.

First, in step S200, the cooling apparatus control unit 60 determines whether the head end position of the material to be rolled 2 has reached the entry side of the rolling mill 10, based on the tracking information. In a case where it is determined to be before reaching, processing in step S210 is next executed. In a case where it is determined to be after reaching, passage of the material to be rolled 2 is waited for.

In step S210, the first valves 43 and 53 of the respective cooling apparatuses are controlled to the open state. More specifically, the remaining coolant discharging section 61 provides ON signal to the first valve control units 44 and 54. The first valve control units 44 and 54 receive the ON signal to each control the first valves 43 and 53 to the open state. Note that, as a condition, spraying of the coolant onto the preceding material to be rolled 2 is already completed. In other words, a tail end of the preceding material to be rolled 2 has already passed through the rolling mill 10 (spray range by downstream cooling apparatus 40).

Next, in step S220, the second valves 45 and 55 are controlled to the closed state by setting the flow rate target values of the respective cooling apparatuses to zero. More specifically, the remaining coolant discharging section 61 sets the flow rate target values of the respective second valve control units 47 and 57 to zero. The second valve control units 47 and 57 each control, by the closed loop control, the valve opening of the second valves 45 and 55 to the fully-closed state such that the flow rate actual values become zero. As a result of the processing in step S210 and step S220, the coolant remaining in the coolant passages 42 and 52 downstream of the second valves 45 and 55 is discharged from the spray nozzles 41 and 51.

Next, in step S230, the flow rate target value of the downstream cooling apparatus 40 is set to a value (>0) corresponding to the target temperature of the material to be rolled 2. More specifically, the flow rate target value setting section 62 sets the flow rate target value of the downstream cooling apparatus 40 to a value corresponding to the target temperature of the material to be rolled 2 on the entry side and the exit side of the rolling mill 10, after execution of the processing in step S220. As a result, the valve opening of the second valve 45 is controlled to the predetermined opening by the closed loop control based on the set flow rate target value, and the coolant amount corresponding to the flow rate target value of the downstream cooling apparatus 40 is sprayed.

Next, in step S240, the cooling apparatus control unit 60 determines whether the cooling capacity of the downstream cooling apparatus 40 is saturated. In a case where it is determined to be a saturated state, it is not possible to cool the material to be rolled 2 to the target temperature only by the spray of the coolant from the downstream cooling apparatus 40. Therefore, it is necessary to spray the coolant also from the upstream cooling apparatus 50. Thus, processing in step S250 is executed.

In step S250, the flow rate target value of the upstream cooling apparatus 50 is set to a value (>0) corresponding to the target temperature of the material to be rolled 2. More specifically, as the flow rate target value of the upstream cooling apparatus 50, an amount of coolant that is insufficient with the cooling capacity of the downstream cooling apparatus 40 is set. As a result, the valve opening of the second valve 55 is controlled to the predetermined opening by the closed loop control based on the set flow rate target value, and the coolant amount corresponding to the flow rate target value of the upstream cooling apparatus 50 is sprayed.

In contrast, in a case where it is determined not to be the saturated state in step S240, the necessary amount of coolant is sprayed only by the downstream cooling apparatus 40. Accordingly, the flow rate target value of the upstream cooling apparatus 50 is set to zero (step S260).

<Effects>

As described above, according to the routine illustrated in FIG. 5, it is possible to compensate the shortage of the cooling capacity of the downstream cooling apparatus 40, by the spray of the coolant from the upstream cooling apparatus 50 in order to cool the material to be rolled 2 to the exit side temperature target value. According to the system of the present embodiment, before the material 2 to be rolled next reaches the rolling mill 10, the first valves 43 and 53 are controlled to the open state and the second valves 45 and 55 are controlled to the closed state, and the coolant remaining in the coolant passages 42 and 52 downstream of the respective second valves 45 and 55 can be discharged at the timing when the coolant does not get on the material to be rolled 2. Thereafter, the flow rate target value corresponding to the target temperature of the material to be rolled 2 is set, and the instructed amount of the coolant is sprayed onto the material to be rolled 2. Therefore, as with the above-described first embodiment, it is possible to suppress rapid cooling of the material to be rolled 2, and to control the rolling mill exit side temperature to the target temperature. Further, since the rapid cooling of the material to be rolled 2 is suppressed, it is possible to improve accuracy of thickness control. Moreover, since the rapid cooling of the material to be rolled 2 is suppressed, it is possible to stabilize passability.

<Modifications>

Incidentally, in the above-described system according to the second embodiment, the arrangement of the downstream cooling apparatus 40 and the upstream cooling apparatus 50 is not limited to the example illustrated in FIG. 5. It is sufficient to install the upstream cooling apparatus 50 upstream of the downstream cooling apparatus 40. Further, three or more cooling apparatus may be provided.

<Hardware Configuration Example>

Figure 6:
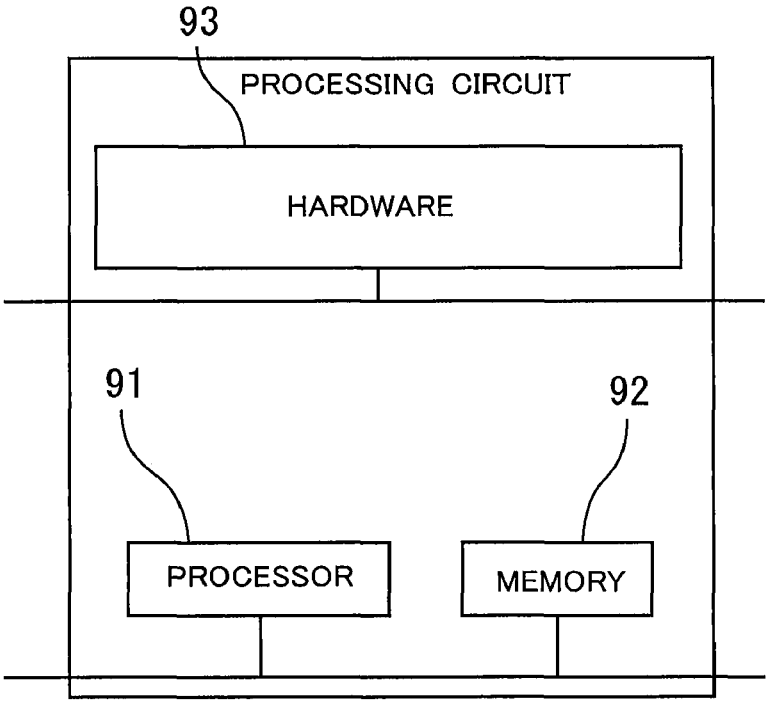
FIG. 6 is a diagram illustrating a hardware configuration example of a processing circuit included in the cooling apparatus control unit 30 or 60.
Figure 7:
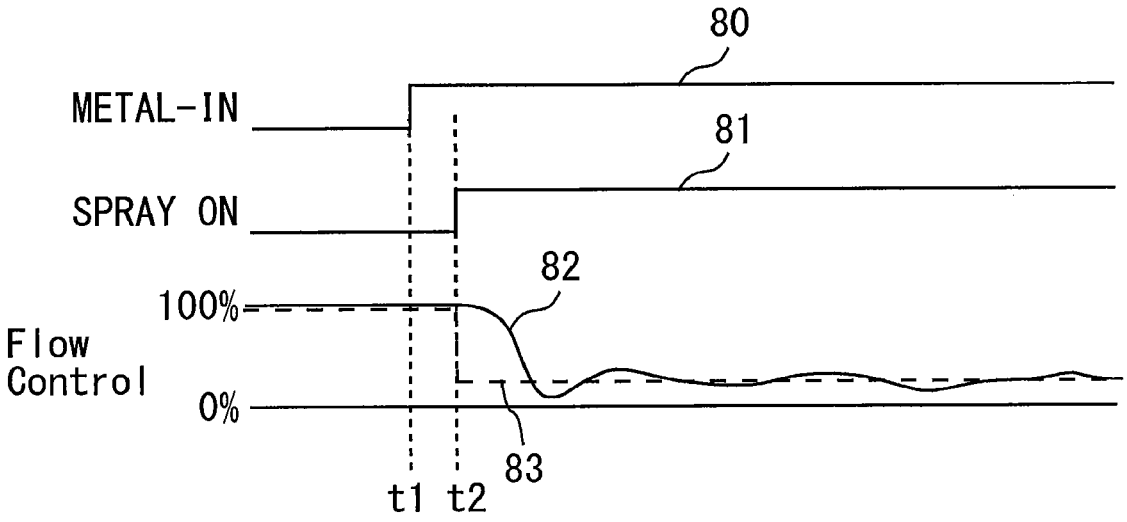
FIG. 7 is a timing chart to explain conventional temperature control by a cooling spray system.

FIG. 6 is a diagram illustrating a hardware configuration example of a processing circuit included in the cooling apparatus control unit 30 or 60. Parts in the cooling apparatus control unit 30 or 60 correspond to a part of the functions, and each of the functions is realized by the processing circuit. For example, the processing circuit includes at least one processor 91 and at least one memory 92. For example, the processing circuit includes at least one dedicated hardware 93.

When the processing circuit includes the processor 91 and the memory 92, each of the functions is realized by software, firmware, or a combination of software and firmware. At least one of the software and the firmware is described as a program. At least one of the software and the firmware is held by the memory 92. The processor 91 reads and executes the program stored in the memory 92, thereby realizing each of the functions. The processor 91 is also referred to as a CPU (Central Processing Unit), a central processing device, a processing device, a computing device, a microprocessor, a microcomputer, or a DSP. Examples of the memory 92 include nonvolatile or volatile semiconductor memory such as a RAM, a ROM, a flash memory, an EPROM, or an EEPROM, a magnetic disk, a flexible disk, an optical disk, a compact disk, a mini disk, or a DVD and the like.

In a case where the processing circuit includes the dedicated hardware 93, the processing circuit is, for example, a single circuit, a composite circuit, a programmed processor, a parallelly-programmed processor, an ASIC, an FPGA, or a combination thereof. For example, each of the functions may be realized by the processing circuit. For example, each of the functions may be collectively realized by the processing circuit.

Furthermore, a part of the functions may be realized by the dedicated hardware 93, and the other part may be realized by software or firmware.

In this way, the processing circuit realizes each of the functions by the hardware 93, the software, the firmware, or a combination thereof. Note that the above-described hardware configuration example is also applicable to each of the first valve control units 24, 44, and 54 and the second valve control units 27, 47, and 57.

REFERENCE SIGNS LIST

2 Material to be rolled
3 Tracking apparatus
4 Host computer
5 Rolling mill entry side temperature sensor
6 Rolling mill exit side temperature sensor
10 Rolling mill
11, 12, 13, 14 Rolling stand
20 Cooling apparatus
21 Spray nozzle
21*a* Upper spray nozzle
21*b* Lower spray nozzle
22 Coolant passage
23 First valve
23*a* Upper spray valve
23*b* Lower spray valve
24 First valve control unit
25 Second valve
26 Flow rate detector
27 Second valve control unit
30 Cooling apparatus control unit
31 Remaining coolant discharging section
32 Flow rate target value setting section
40 Downstream cooling apparatus
41 Spray nozzle
41*a* Upper spray nozzle
41*b* Lower spray nozzle
42 Coolant passage
43 First valve
43*a* Upper spray valve
43*b* Lower spray valve
44 First valve control unit
45 Second valve
46 Flow rate detector
47 Second valve control unit
50 Upstream cooling apparatus
51 Spray nozzle
51*a* Upper spray nozzle
51*b* Lower spray nozzle
52 Coolant passage
53 First valve
53*a* Upper spray valve
53*b* Lower spray valve
54 First valve control unit
55 Second valve
56 Flow rate detector
57 Second valve control unit
60 Cooling apparatus control unit
61 Remaining coolant discharging section
62 Flow rate target value setting section
91 Processor
92 Memory
93 Hardware

The invention claimed is:

1. A rolling mill exit side temperature control system including a plurality of rolling stands rolling a material to be rolled, the system comprising:

a cooling apparatus provided in at least one of a plurality of spaces between the rolling stands; and a cooling apparatus control unit controlling the cooling apparatus, wherein the cooling apparatus includes a spray nozzle spraying coolant onto the material to be rolled, a coolant passage supplying the coolant to the spray nozzle, a first valve in the coolant passage upstream of the spray nozzle in a coolant flow direction and being changeable to an open state or a closed state, a first valve control unit controlling the first valve to the open state or the closed state, a second valve in the coolant passage upstream of the first valve in the coolant flow direction and being changeable in valve opening, a flow rate detector detecting a flow rate of the coolant flowing through the coolant passage upstream of the second valve, a second valve control unit controlling opening of the second valve to cause a flow rate actual value detected by the flow rate detector to coincide with a flow rate target value, and the cooling apparatus control unit includes a remaining coolant discharging section controlling the first valve to the open state and the second valve to the closed state by setting the flow rate target value to zero before the material to be rolled reaches the rolling mill, and a flow rate target value setting section setting the flow rate target value to a value corresponding to a target temperature of the material to be rolled after the control by the remaining coolant discharging section.

2. The rolling mill exit side temperature control system according to claim 1, wherein the cooling apparatus includes a first cooling apparatus and a second cooling apparatus:

the first cooling apparatus is in any of the plurality of spaces between the rolling stands; and the second cooling apparatus is in any of the plurality of spaces between the rolling stands upstream of the first cooling apparatus in a material rolling direction, the remaining coolant discharging section controls the first valve to the open state and the second valve to the closed state by setting the flow rate target value to zero, in the first cooling apparatus and the second cooling apparatus, before the material to be rolled reaches the rolling mill, the flow rate target value setting section sets the flow rate target value of the first cooling apparatus to a value corresponding to the target temperature of the material to be rolled, after the control by the remaining coolant discharging section, set the flow rate target value of the second cooling apparatus to zero in a case where a cooling capacity of the first cooling apparatus is not saturated, and set the flow rate target value of the second cooling apparatus to a value corresponding to the target temperature of the material to be rolled in a case where the cooling capacity of the first cooling apparatus is saturated.

3. The rolling mill exit side temperature control system according to claim 1, wherein the rolling mill is a finishing mill.

4. The rolling mill exit side temperature control system according to claim 1, wherein the rolling mill is a roughing mill.

5. The rolling mill exit side temperature control system according to claim 1, wherein the cooling apparatus control unit controls the first valve to the closed state after a preceding material to be rolled passes the rolling mill.

* * * * *